US010767431B2

(12) United States Patent
Mageren

(10) Patent No.: US 10,767,431 B2
(45) Date of Patent: Sep. 8, 2020

(54) INNER BARREL CRIMPING CONNECTION FOR A CORING TOOL

(71) Applicant: Halliburton Energy Services, Inc., Houston, TX (US)

(72) Inventor: Olivier Mageren, Brussels (BE)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 120 days.

(21) Appl. No.: 16/075,349

(22) PCT Filed: Mar. 3, 2016

(86) PCT No.: PCT/US2016/020591
§ 371 (c)(1),
(2) Date: Aug. 3, 2018

(87) PCT Pub. No.: WO2017/151130
PCT Pub. Date: Sep. 8, 2017

(65) Prior Publication Data
US 2019/0040701 A1 Feb. 7, 2019

(51) Int. Cl.

| | |
|---|---|
| ***E21B 25/00*** | (2006.01) |
| ***E21B 17/06*** | (2006.01) |
| ***E21B 17/04*** | (2006.01) |
| ***E21B 10/02*** | (2006.01) |
| ***E21B 25/04*** | (2006.01) |
| ***E21B 25/02*** | (2006.01) |

(52) U.S. Cl.
CPC ..... *E21B 25/04* (2013.01); *E21B 17/04* (2013.01); *E21B 17/06* (2013.01); *E21B 25/005* (2013.01); *E21B 25/02* (2013.01); *E21B 10/02* (2013.01)

(58) Field of Classification Search
CPC ..... E21B 10/02; E21B 17/04; E21B 17/046; E21B 25/00
See application file for complete search history.

(56) References Cited

U.S. PATENT DOCUMENTS 1,554,067 A * 9/1925 Brandel ..... E21B 10/02 175/239
1,586,415 A * 5/1926 Oswald ..... E21B 10/02 175/245

(Continued)

FOREIGN PATENT DOCUMENTS

CN 2585968 Y 11/2003
CN 2809200 Y 8/2006

(Continued)

OTHER PUBLICATIONS

International Search Report and Written Opinion for PCT Patent Application No. PCT/US2016/020616, dated Nov. 29, 2016; 17 pages.

(Continued)

*Primary Examiner* — Jennifer H Gay
(74) *Attorney, Agent, or Firm* — Baker Botts L.L.P.

(57) ABSTRACT

A crimping connection for an inner tube is disclosed. An inner barrel system includes a first coring inner barrel; a second coring inner barrel; and a crimp ring overlapping an end of the first coring inner barrel and an end of the second coring inner barrel and compressed to mechanically couple the first coring inner barrel with the second coring inner barrel.

20 Claims, 5 Drawing Sheets

(56) References Cited

U.S. PATENT DOCUMENTS

| | | | | | |
|---|---|---|---|---|---|
| 1,936,669 | A * | 11/1933 | Heeter | E21B 17/06 | 285/3 |
| 1,984,867 | A * | 12/1934 | Dean | E21B 25/00 | 175/251 |
| 2,499,543 | A | 3/1950 | Townsend | | |
| 3,114,566 | A * | 12/1963 | Coberly | F16L 15/008 | 285/18 |
| 3,363,703 | A | 1/1968 | Parkes | | |
| 3,621,924 | A * | 11/1971 | Lebourg | E21B 25/06 | 175/58 |
| 4,499,924 | A | 2/1985 | Garrett | | |
| 4,916,945 | A * | 4/1990 | Weisbrod | E21B 25/005 | 73/152.11 |
| 5,107,942 | A * | 4/1992 | Radford | F16C 17/18 | 175/244 |
| 5,163,522 | A | 11/1992 | Eaton et al. | | |
| 5,577,857 | A * | 11/1996 | Miyasaka | E02D 5/52 | 403/316 |
| 5,746,253 | A | 5/1998 | Dust et al. | | |
| 8,047,281 | B2 | 11/2011 | Costa et al. | | |
| 8,579,049 | B2 | 11/2013 | Kinsella | | |
| 8,783,361 | B2 | 7/2014 | Zediker et al. | | |
| 2006/0032640 | A1* | 2/2006 | Costa | E21B 17/04 | 166/384 |
| 2006/0237232 | A1* | 10/2006 | Cravatte | E21B 25/00 | 175/20 |
| 2007/0246934 | A1* | 10/2007 | Heertjes | E21B 43/103 | 285/24 |
| 2012/0037427 | A1 | 2/2012 | Kinsella | | |
| 2012/0234607 | A1 | 9/2012 | Kinsella | | |
| 2014/0311741 | A1 | 10/2014 | Tunget | | |
| 2015/0233201 | A1 | 8/2015 | Kvinnesland | | |
| 2015/0275604 | A1* | 10/2015 | Norrie | E21B 25/00 | 175/58 |
| 2015/0337654 | A1 | 11/2015 | Alshannaq et al. | | |
| 2018/0195358 | A1* | 7/2018 | Quintana Martinez | E21B 25/10 | |
| 2019/0040701 | A1* | 2/2019 | Mageren | E21B 25/04 | |
| 2019/0119990 | A1* | 4/2019 | Fredriksen | E21B 17/003 | |
| 2019/0264521 | A1* | 8/2019 | Mageren | E21B 25/005 | |

FOREIGN PATENT DOCUMENTS

| | | | |
|---|---|---|---|
| CN | 101187296 | A | 5/2008 |
| CN | 201371477 | | 12/2009 |
| EP | 0248615 | A2 | 12/1987 |
| EP | 2452038 | | 8/2013 |
| WO | 2011/003990 | A2 | 1/2011 |
| WO | 2012/069713 | A1 | 5/2012 |
| WO | 2014-018737 | | 1/2014 |

OTHER PUBLICATIONS

238-P Powered Soil Pipe Cutter, https://www.ridgid.com/us/en/238p-powered-soil-pipe-cutter, Emerson Electric Co., web accessed Jul. 20, 2018, 5 pages.

Screen captures from YouTube video clip entitled, "RIDGID Powered Soil Pipe Cutter," 3 pages, uploaded on Feb. 4, 2013 by "RIDGID Tools", Retrieved from the Internet: https://www.youtube.com/watch?v=IYHZPlhmqkg.

"Wireline Coring," ALS Oil & Gas, http://www.corpro-group.com/service-offering/downhole-equipment/wireline-coring/, 2013.

International Preliminary Report on Patentability, Application No. PCT/US2016/020591, dated Sep. 13, 2018, 11 pgs.

Canadian Office Action, Application No. 3,010,879, dated Apr. 15, 2019, 3 pgs.

Chinese Office Action, Application No. 201680076513.8, dated Oct. 31, 2019, 12 pgs.

* cited by examiner

INNER BARREL CRIMPING CONNECTION FOR A CORING TOOL

RELATED APPLICATIONS

This application is a U.S. National Stage Application of International Application No. PCT/US2016/020591 filed Mar. 3, 2016, which designates the United States, and which is incorporated herein by reference in its entirety.

TECHNICAL FIELD

The present disclosure relates generally to downhole coring operations and, more particularly, to an inner barrel crimping connection for a coring tool.

BACKGROUND

Conventional coring tools used to obtain core samples from a borehole include a tubular housing attached at one end to a special bit often referred to as a core bit, and at the other end to a drill string extending through the borehole to the surface. The tubular housing is usually referred to as an outer barrel or core barrel. The outer barrel contains an inner barrel or inner tube with a space between the outer surface of the inner barrel and the inner surface of the outer barrel. During a coring operation, the core bit drills into a formation and extracts a core sample of that formation. The core sample enters and fills the inner barrel, which is then subsequently returned to the surface.

BRIEF DESCRIPTION OF THE DRAWINGS

For a more complete understanding of the present disclosure, its features and advantages, reference is now made to the following description, taken in conjunction with the accompanying drawings, in which.

DETAILED DESCRIPTION

The present disclosure relates to coring tools and, in particular, to methods of using a crimp ring to couple two inner barrel sections. An end of a first inner barrel is inserted into a first end of the crimp ring and an end of a second inner barrel is inserted into a second end of the crimp ring. The first and second ends of the crimp ring are then compressed to mechanically couple the crimp ring to the ends of the first and second inner barrels. The crimp ring additionally includes a shear zone that is configured in a variety of ways such that it is easier to sever than adjacent portions of the crimp ring. For example, the shear zone may be less ductile and/or more brittle than adjacent portions of the crimp ring. The shear zone may be characterized in terms of factors that affect the relative ease by which the crimp ring severs at the shear zone. For example, the shear zone may be constructed of a relatively weak or brittle material in comparison with the material used to construct adjacent portions of the crimp ring. As another example, the shear zone may be the same material as the crimp ring, but may be thinner or heat treated locally, such as with a laser, to create an area that is more brittle or easier to sever than the adjacent portions of the crimp ring such that shear zone may be severed with less force than adjacent portions of the crimp ring. The shear zone allows for easier separation of the inner barrels and the core samples, which may be separated into approximately thirty foot sections after removal from a wellbore. For example, the crimp ring may reduce the associated time, labor, and expense involved in coupling inner barrels. Additionally, using a crimp ring may allow the inner barrels to be reused as the crimp ring is severed after a coring operation instead of the inner barrels. Further, the shear zone may reduce associated time, labor, and expense involved in separating the inner barrels. As compared to prior coring tools and methods, those of the present disclosure may be more versatile and/or easier-to-use and may also provide higher quality core samples or core sample measurements as there will be no rotation of the inner barrels during separation.

Embodiments of the present disclosure and their advantages may be better understood by referring to FIGS. 1-4, where like numbers are used to indicate like and corresponding parts.

Figure 1:
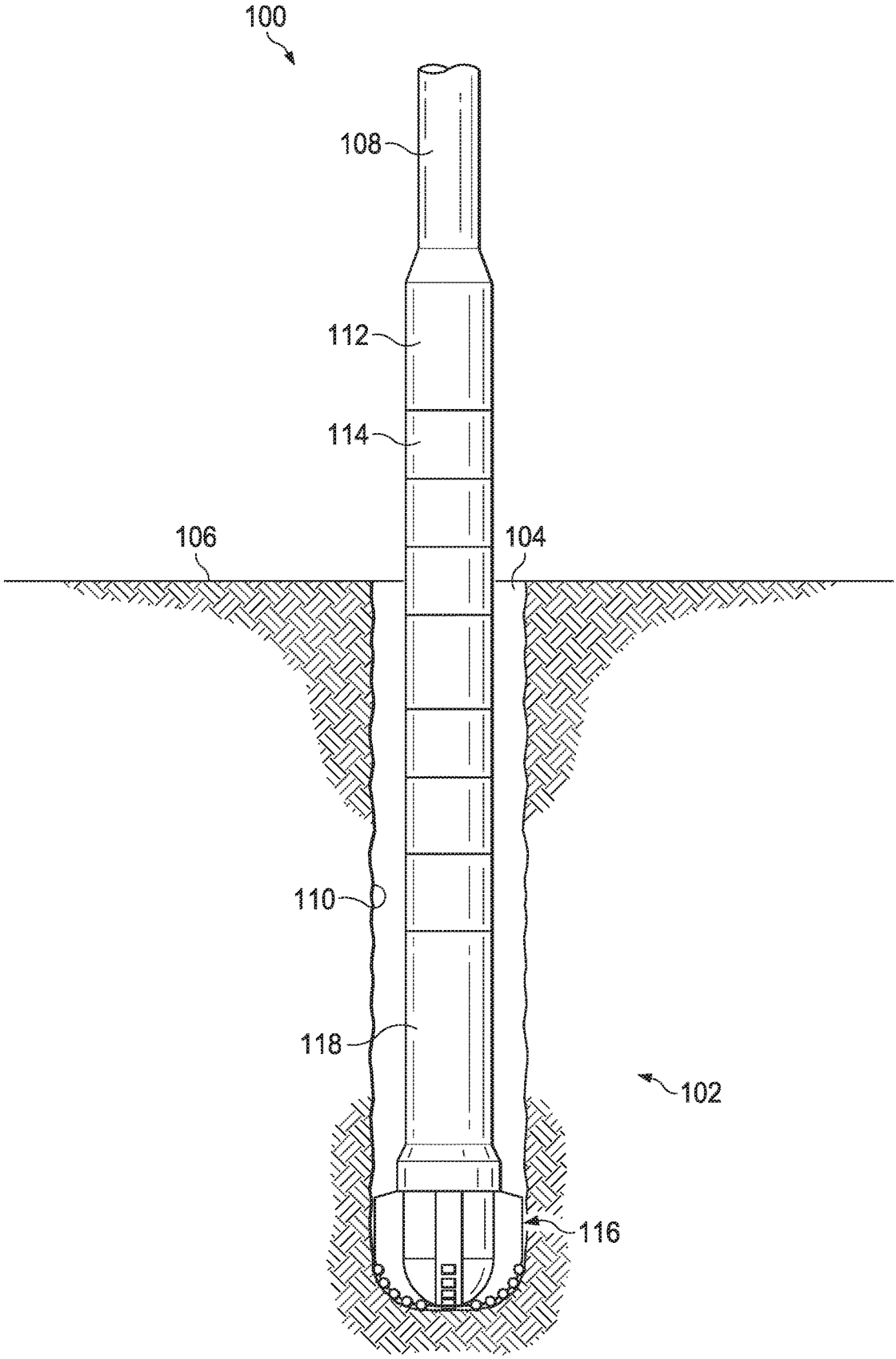
FIG. 1 is an elevation view, with portions broken away, of a drilling system.

FIG. 1 is an elevation view, with portions broken away, of a drilling system 100 at a well site 106. A drilling rig (not expressly shown) may be included at the well site 106 to support and operate a drill string 108 at the well site 106 for drilling a wellbore 104. Such a drilling rig may be used to suspend the drill string 108 over the wellbore 104 as the wellbore 104 is drilled, and may include various types of drilling equipment such as a rotary table, drilling fluid pumps, and drilling fluid tanks used in drilling. Such a drilling rig may have various characteristics and features associated with a "land drilling rig," such as a rig floor. However, the present teachings are not limited to use with a land drilling rig and may be equally used with offshore platforms, drill ships, semi-submersibles, and drilling barges.

The drill string 108 further includes a bottom hole assembly (BHA) 112. The BHA 112 may be assembled from a plurality of various components that operationally assist in forming the wellbore 104 including extracting core samples from the wellbore 104. For example, the BHA 112 may include drill collars, rotary steering tools, directional drilling tools, downhole drilling motors, drilling parameter sensors for weight, torque, bend and bend direction measurements of the drill string and other vibration and rotational related sensors, hole enlargers such as reamers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number and different types of components included in the BHA 112 may depend upon anticipated downhole drilling conditions and the type of wellbore that will be formed.

The BHA 112 may include a swivel assembly 114. The swivel assembly 114 may be an integrated component of a coring tool 102 used to isolate rotation of and torque used in rotation of a core bit 116 from other components of the coring tool 102, such as the inner barrel (as shown in FIG. 2).

The coring tool 102 (as shown in more detail in FIG. 2) is coupled to the drill string 108. The coring tool 102 and the drill string 108 extend down from the well site 106. The coring tool 102 includes a core bit 116, which may have a central opening and may include one or more blades disposed outwardly from exterior portions of a bit body of the core bit 116. The bit body may be generally curved and the one or more blades may be any suitable type of projections extending outwardly from the bit body. The blades may include one or more cutting elements disposed outwardly from exterior portions of each blade. The core bit 116 may be any of various types of fixed cutter core bits, including polycrystalline diamond cutter (PDC) core bits, including thermally stable polycrystalline diamond cutter (TSP) core bits, matrix core bits, steel body core bits, hybrid core bits, and impreg core bits operable to extract a core sample from the wellbore 104. The core bit 116 may have many different designs, configurations, or dimensions according to the particular application of the core bit 116. The coring tool 102 further includes an outer barrel 118 and an inner barrel (discussed in detail with reference to FIG. 2) located inside the outer barrel 118.

Figure 2:
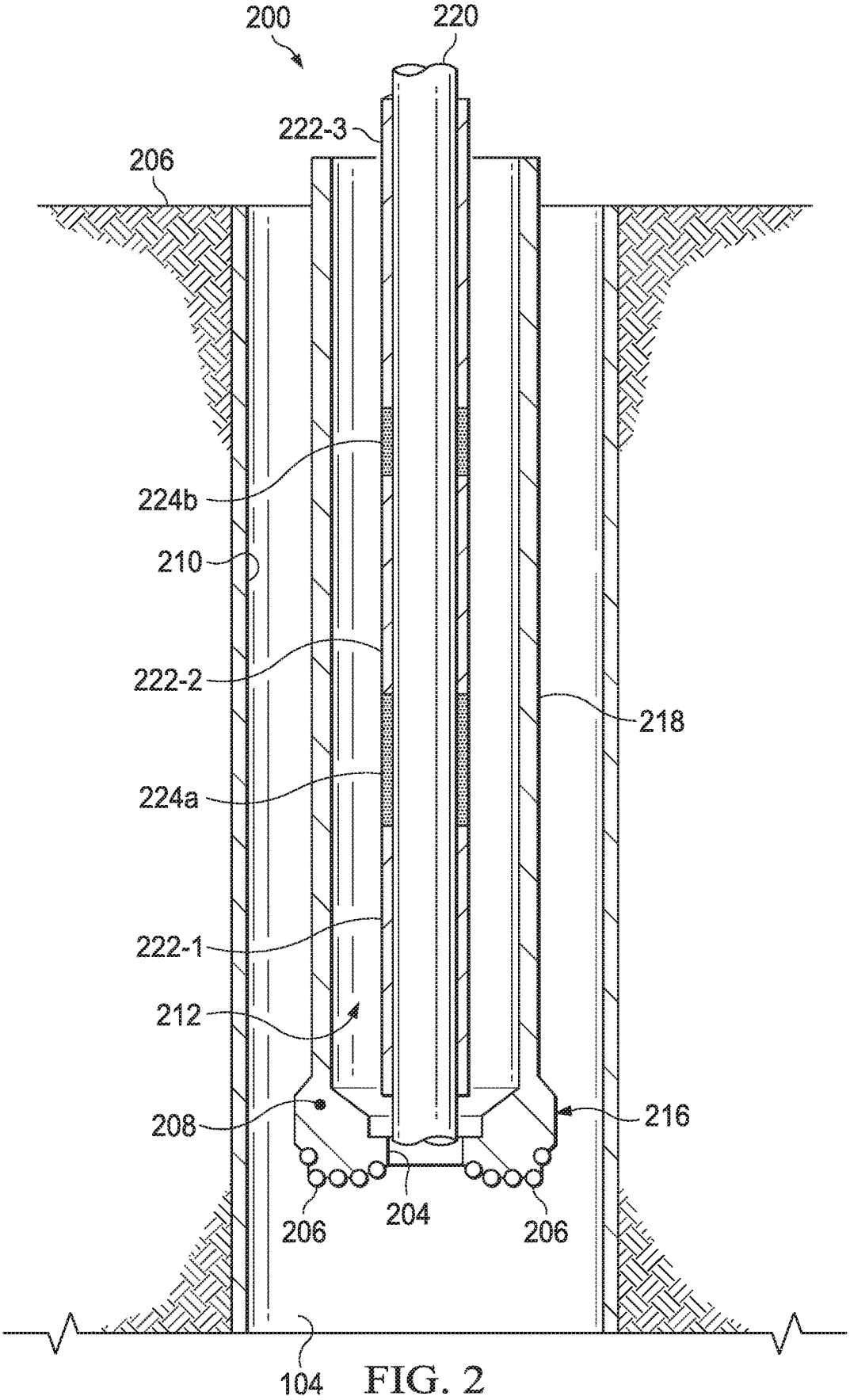
FIG. 2 is a cross-sectional view of the coring tool of FIG. 1 used to extract a core sample from a wellbore.

FIG. 2 is a cross-sectional view of the coring tool 102, as shown in FIG. 1, used to extract and store, after extraction, a core sample 220 from the wellbore 104. The coring tool 102 includes the core bit 116 having a generally cylindrical body and including a throat 204 that extends longitudinally through the core bit 116. The throat 204 of the core bit 116 may receive the core sample 220. The core bit 116 includes one or more cutting elements 206 disposed outwardly from exterior portions of a core bit body 208. For example, a portion of each cutting element 206 may be directly or indirectly coupled to an exterior portion of the core bit body 208. Cutting elements 206 may be any suitable device configured to cut into a formation, including but not limited to, primary cutting elements, back-up cutting elements, secondary cutting elements or any combination thereof. By way of example and not limitation, cutting elements 206 may be various types of cutting elements, compacts, buttons, inserts, and gage cutting elements satisfactory for use with a wide variety of core bits 116.

In operation, the core bit 116 extracts the core sample 220 from a formation such that the core sample 220 has a diameter that is approximately equal to or less than the diameter of the throat 204. The core bit 116 may be coupled to or integrated with the outer barrel 118. The outer barrel 118 is separated from inner barrels 216 by an annulus 212 that may have a generally cylindrical geometry. The outer barrel 118 may include barrel stabilizers (not expressly shown) to stabilize and provide consistent stand-off of the outer barrel 118 from a sidewall 210. Further, the outer barrel 118 may include additional components, such as sensors, receivers, transmitters, transceivers, sensors, calipers, and/or other electronic components that may be used in a downhole measurement system or other particular implementation. The outer barrel 118 may be coupled to and remain in contact with the well site 106 during operation.

Inner barrels 216-1, 216-2 and 216-3 (collectively "inner barrels 216") pass through the outer barrel 118. The inner barrels 216 may have a generally cylindrical geometry. The inner barrels 216 may be housed in the outer barrel 118 and may be configured to slidably move uphole and downhole partially within the outer barrel 118. In some configurations, the inner barrels 216 may extend beyond the outer barrel 118.

The inner barrels 216 may house the core sample 220 extracted from the formation surrounding the wellbore 104. Following extraction from the wellbore 104, the core sample 220 is stored in the inner barrels 216 and later returned to the surface by retrieving the inner barrels 216 by wireline or by extraction of the coring assembly from the wellbore 104. Once the core sample 220 is returned to the surface, it may be severed, such as by cutting, shearing, or breaking, into multiple segments for box storage, transportation and further processing. For example, core sample may be severed to separate the core sample in the inner barrel 216-1, the core sample in the inner barrel 216-2, and the core sample in the inner barrel 216-3. As discussed in further detail below, use of the inner barrels 216 of the present disclosure may minimize damage to the core sample 220 during severing and transport.

The crimp ring 224 may couple or connect different inner barrels 216. For example, the crimp ring 224*a* couples the inner barrel 216-1 to the inner barrel 216-2 and the crimp ring 224*b* couples the inner barrel 216-2 to the inner barrel 216-3. In some examples, the crimp ring 224 may be constructed of the same or similar material as the inner barrels 216. In other examples, the crimp ring 224 may be constructed of a different material from the inner barrels 216. For example, the crimp ring 224 may be made of a multi-material including a mixture or composite of steel, plastic, or other suitable material.

Figure 3A:
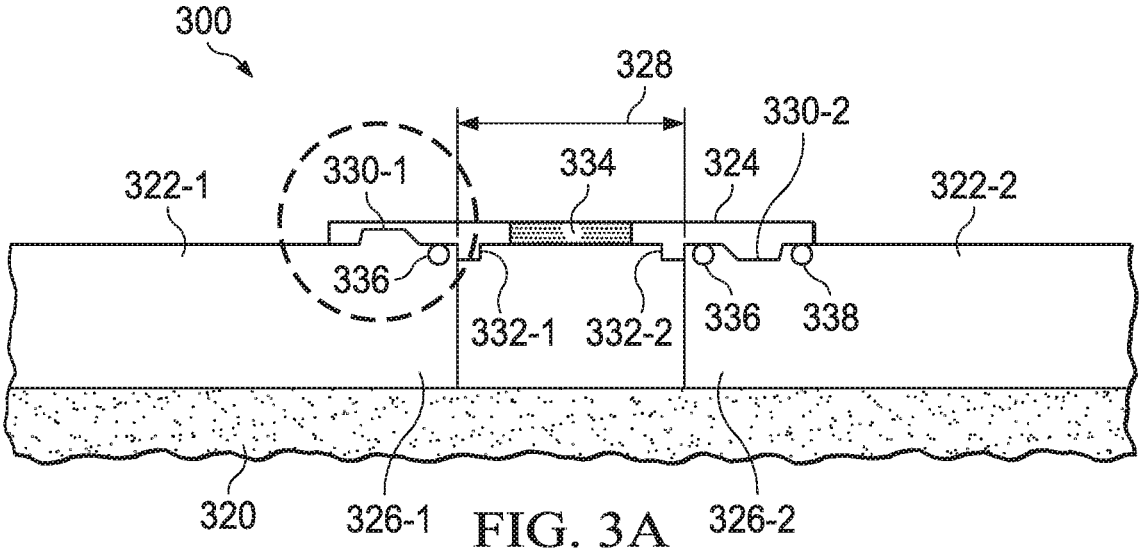
FIGS. 3A-3I is an exemplary inner barrel system used to couple two sections of an inner barrel with a crimp ring.

The crimp ring 224 may further include a shear zone (as shown in FIG. 3A) extending longitudinally for at least a portion of the crimp ring 224. The shear zone may be of any suitable length and may be configured to enable severing of the crimp ring 224 using a fast pipe cutter or other cutting tool. The shear zone may be formed of the same or similar material as the adjacent portions of the crimp ring 224 but may be thinner than adjacent portions of the crimp ring 224 such that the shear zone may be easier to sever after the coring operation. In other examples, the shear zone may be made of a different material that the adjacent portions of the crimp ring 224 or may be treated such that the shear zone is more brittle, easier to sever, or has a lower ductility. For example, the shear zone of the crimp ring 224 may be constructed of a material that maintains yield strength and tensile strength approximately equivalent to the yield strength and tensile strength of the inner barrels 216 including cast iron, aluminum smelting, or other material with that becomes more brittle with heat treatment. Additionally, by way of example and not limitation, the shear zone of the crimp ring 224 may have a ductility according to the following elongation ratio:

where:

$$\left(\frac{\varepsilon_{crimp\ ring}}{\varepsilon_{shear\ zone}} = \right)\varepsilon_{ratio} \geq 1 \tag{1}$$

$\varepsilon_{crimp\ ring}$=elongation of adjacent portions of the crimp ring;

$\varepsilon_{shear\ zone}$=elongation of the shear zone; and $\varepsilon_{ratio}$=elongation ratio.

As another example, the shear zone may be an area that has been heat treated locally, such as with a laser, to create an area of the crimp ring 224 that is more brittle than the inner barrels 216. The crimp ring 224 allows for easier separation of the inner barrels 216 and separation of the core sample 220 into sections after removal from the wellbore 104 as the crimp ring 224 is easier to sever than the inner barrels 216. The properties of the shear zone may be created through any suitable process for increasing the brittleness of metal such as hardening by quenching, creating a heat-affected zone.

FIG. 3A is an exemplary inner barrel system used to couple two sections of an inner barrel with a crimp ring. The inner barrel system 300 includes inner barrels 322-1 and

322-2 coupled by a crimp ring 324. The inner barrels 322 may be configured to connect or couple to other inner barrels 322 using additional crimp rings 324. The crimp ring 324 may be made of any suitable ductile material that withstands the conditions in the wellbore and has a high yield strength and high elongation, such as aluminum, steel, stainless steel, or copper. For example, the crimp ring 324 may be made of a stainless steel, such as AISI 316 stainless steel.

The crimp ring 324 may be installed on the inner barrels 322 before the inner barrels 322 are inserted into the outer barrel and the assembly deployed downhole. For example, at the well site, such as the well site 106 shown in FIG. 1, the crimp ring 324 may be placed over the gap 328 between the end 326-1 of the inner barrel 322-1 and the end 326-2 of the inner barrel 322-1. The crimp ring 324 may be installed on the outer perimeter of the inner barrel 322 by inserting an end of the inner barrel 322 into an end of the crimp ring 324 until the inner barrel 322 is inserted a predetermined distance. After the inner barrel 216 is inserted into an end of the crimp ring 324, the crimp ring 324 may be compressed and plastically deformed—generally referred to as crimping—to fit snugly against the outer perimeter of the inner barrels 322 such that the crimp ring 324 couples to the inner barrel 322-1. This process may be repeated to couple the crimp ring 324 with a second inner barrel 322 such that two inner barrels 322 are coupled together. The crimp ring 324 may be crimped by any suitable means of deforming metal, such as through the use of a piston-pressure device or a crimping tool.

The crimp ring 324 may be preinstalled on an end of the inner barrel 322. For example, the crimp ring 324 may be preinstalled on the end 326-1 of the inner barrel 322-1 prior to deployment of the inner barrel 322-1 to the well site. The crimp ring 324 may be coupled to the end 326-1 via any suitable coupling, such as welding, crimping, or threading. When the inner barrel 322-1 arrives at the well site, the end 326-2 of the inner barrel 322-2 may be inserted into the crimp ring 324 and the crimp ring 324 may be compressed to couple the crimp ring 324 to the inner barrel 322-2 and thus couple the inner barrel 322-1 to the inner barrel 322-2. Preinstallation of the crimp ring 324 on one inner barrel 322 may reduce the assembly time of the coring system at the well site.

Figure 3B:
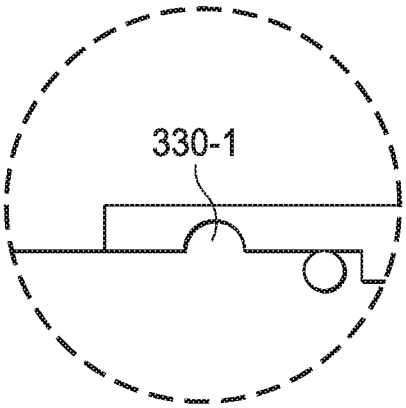
Figure 3C:
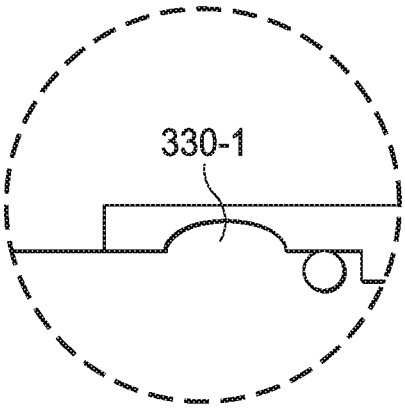
Figure 3D:
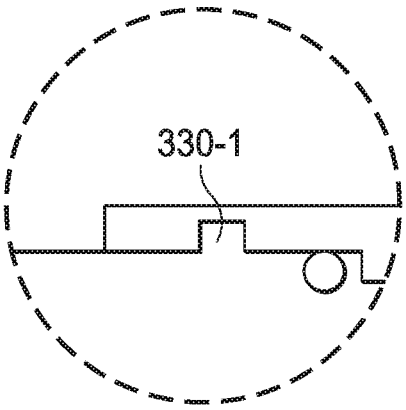
Figure 3E:
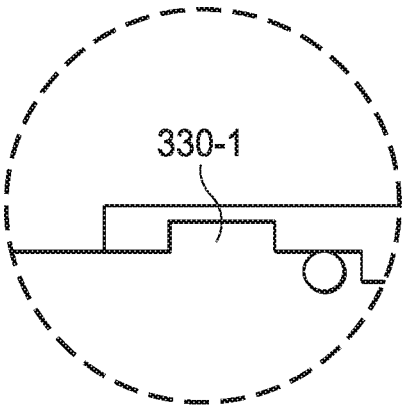
Figure 3F:
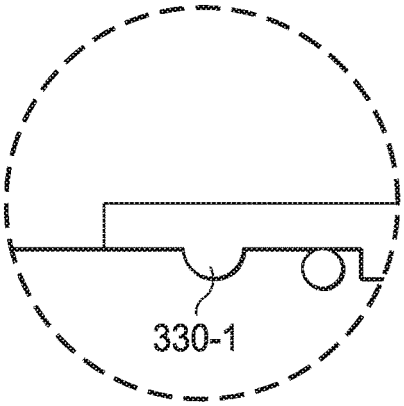
Figure 3G:
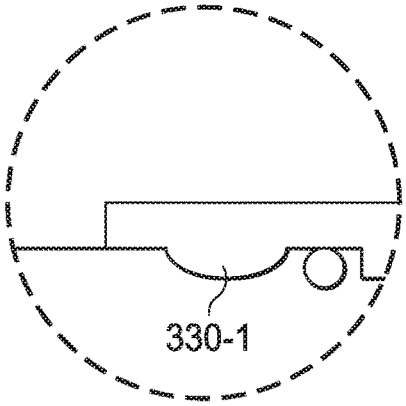
Figure 3H:
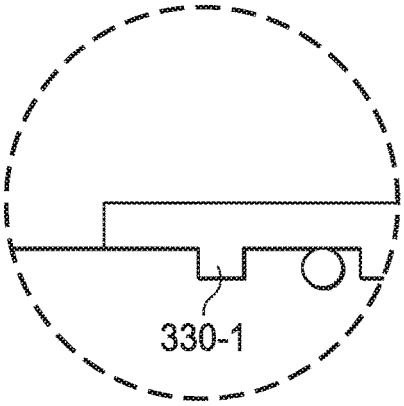
Figure 3I:
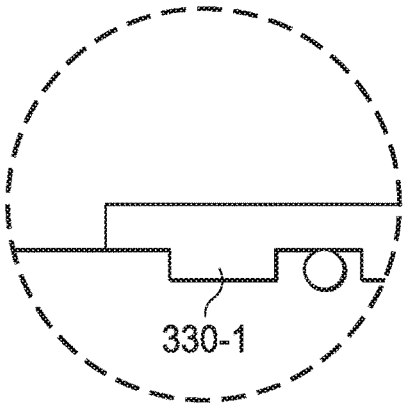

In some examples, the crimp ring 324 may be located over one or more protrusions 330. The protrusions 330 may be formed on the outer perimeter of the inner barrels 322 to increase the physical interference between the crimp ring 324 and the inner barrel 322 after the crimp ring 324 has been crimped. The increased physical interference increases the mechanical contact friction between the crimp ring 324 and the inner barrel 322 and increases the pulling force required to separate the crimp ring 324 from the inner barrel 322 when an axial force is applied to the system 300. In some examples, the protrusion 330 may have a positive shape and extend above the surface of the outer perimeter of the inner barrel 322. The protrusion 330-1 is an example of a positive shape. In other examples, the protrusion 330 may have a negative shape and extend below the surface of the outer perimeter of the inner barrel 322. The protrusion 330-2 is an example of a negative shape. The cross-sectional shape of the protrusion 330 may be any suitable geometry including circular, oval, square, rectangular, or trapezoidal. For example, in FIG. 3A, the protrusion 330-1 has a positive trapezoidal shape and the protrusion 330-2 has a negative trapezoidal shape. For further examples, FIG. 3B illustrates the protrusion 330-1 with a positive circular shape, FIG. 3C illustrates the protrusion 330-1 with a positive oval shape, FIG. 3D illustrates the protrusion 330-1 with a positive square cross-sectional shape, FIG. 3E illustrates the protrusion 330-1 with a positive rectangular shape, FIG. 3F illustrates the protrusion 330-1 with a negative circular shape, FIG. 3G illustrates the protrusion 330-1 with a negative oval shape, FIG. 3H illustrates the protrusion 330-1 with a negative square cross-sectional shape, and FIG. 3I illustrates the protrusion 330-1 with a negative rectangular shape. While the inner barrels 322 are illustrated in FIG. 3A as each having one protrusion 330, the inner barrels 322 may have any number of protrusion, any combination of geometry, and any combination of positive and negative shapes.

The protrusion 330 may additionally provide a visual indicator during installation of the crimp ring 324. For example, an installer of the crimp ring 324 may visually determine that the crimp ring 324 is properly placed when the crimp ring 324 is situated over the protrusions 330. When the crimp ring 324 is in place over the end 326 of the inner barrel 322, a crimping tool may be used to compress the crimp ring 324 to couple the inner barrels 322.

The crimp ring 324 may additionally include one or more shoulders 332 on the inner perimeter of the crimp ring 324 near one or both axial ends of the crimp ring 324. The shoulders 332 may be placed at a distance from the axial end of the crimp ring 324 such that the crimp ring 324 overlaps the ends 326 of the inner barrels 322 by an amount that provides sufficient mechanical contact friction between the inner perimeter of the crimp ring 324 and the outer perimeter of the inner barrel 322. For example, the crimp ring 324 may overlap the ends 326 by a distance between approximately one and five times the diameter of the inner barrel 322. The shoulders 332 may be used to prevent the ends 326-1 and 326-2 of the inner barrels 322 from contacting each other after the inner barrels 322-1 and 322-2 are coupled together, leaving a gap 328 between the ends 326-1 and 326-2. The gap 328 may reduce the time used to sever and separate the inner barrels 332-1 and 332-2 after the coring operation as the cutting tool severs the crimp ring 324 and does not damage the inner barrels 322. Leaving the inner barrels 322 intact may allow the inner barrels 322 to be reused in another coring operation.

The crimp ring 324 may further include a shear zone 334 extending longitudinally for at least a portion of the crimp ring 324. The shear zone 334 may be of any suitable length and may be configured to enable severing of the crimp ring 324 using a fast pipe cutter or other cutting tool. The shear zone 334 may be formed of the same or similar material as the adjacent portions of the crimp ring 324 but may be thinner than other portions of the crimp ring 324 such that the shear zone 334 may be easier to sever after the coring operation. In some examples, the shear zone 334 may be an area that has been heat treated locally, such as with a laser, to create an area that is more brittle or easier to sever than other areas of the crimp ring 324 such that the shear zone 334 may be severed with less force than other areas of the crimp ring 324. A more brittle shear zone 334 allows for easier severing of the crimp ring 324 and separation of the core sample 320 into sections after removal from the wellbore, such as the wellbore 104 shown in FIG. 1. Additionally, the shear zone 334 may be scored to allow for easier severing of the crimp ring 324 after removal from the wellbore.

The crimp ring 324 may additionally include one or more sealing members 336 on the inner perimeter of the crimp ring 324. The sealing members 336 may provide a secondary seal where the crimp ring 324 couples to the inner barrels 322. The sealing members 336 may be any suitable seal type including an O-ring, a V-ring, or a lip seal. The sealing member 336 may be made of any suitable elastomeric material. The elastomeric material may be formed of compounds including, but not limited to, natural rubber, nitrile rubber, hydrogenated nitrile, urethane, polyurethane, fluorocarbon, perflurocarbon, propylene, neoprene, hydrin, etc, or a soft material including, but not limited to, bronze and brass.

The crimp ring 324 may further include a gripping ring 338 located along the inner perimeter of the crimp ring 324. The gripping ring 338 may be a one-way clamp such that the inner barrel 322-2 may be pushed into the crimp ring 324, but may not be pulled out of the crimp ring 324. The gripping ring 338 may provide for easier installation and coupling of the crimp ring 324 and the inner barrels 322.

The crimp rings 324 may be used to couple multiple sections of the inner barrels 322 together. For example, at the well site 106 as shown in FIG. 1, the crimp rings 324 may be used to couple a series of inner barrels 322 together. During coring operations, the core sample 320 may be captured and housed in the inner barrels 322, which may be returned to the surface. After the inner barrels 322 return to the surface with an extracted core sample 320, the shear zones 334 allow for efficient severing and separation of each inner barrel. The core sample 320 may be severed to separate the core sample 320 in the different inner barrels 322.

In some examples, after the coring operation, the crimp ring 324 may be severed using the same crimping tool used to compress crimp ring 324 during the installation process. For example, some crimping tools have removable jaws such that a crimping jaw may be used during installation and a cutting jaw may be used to sever the crimp ring 324.

Figure 4:
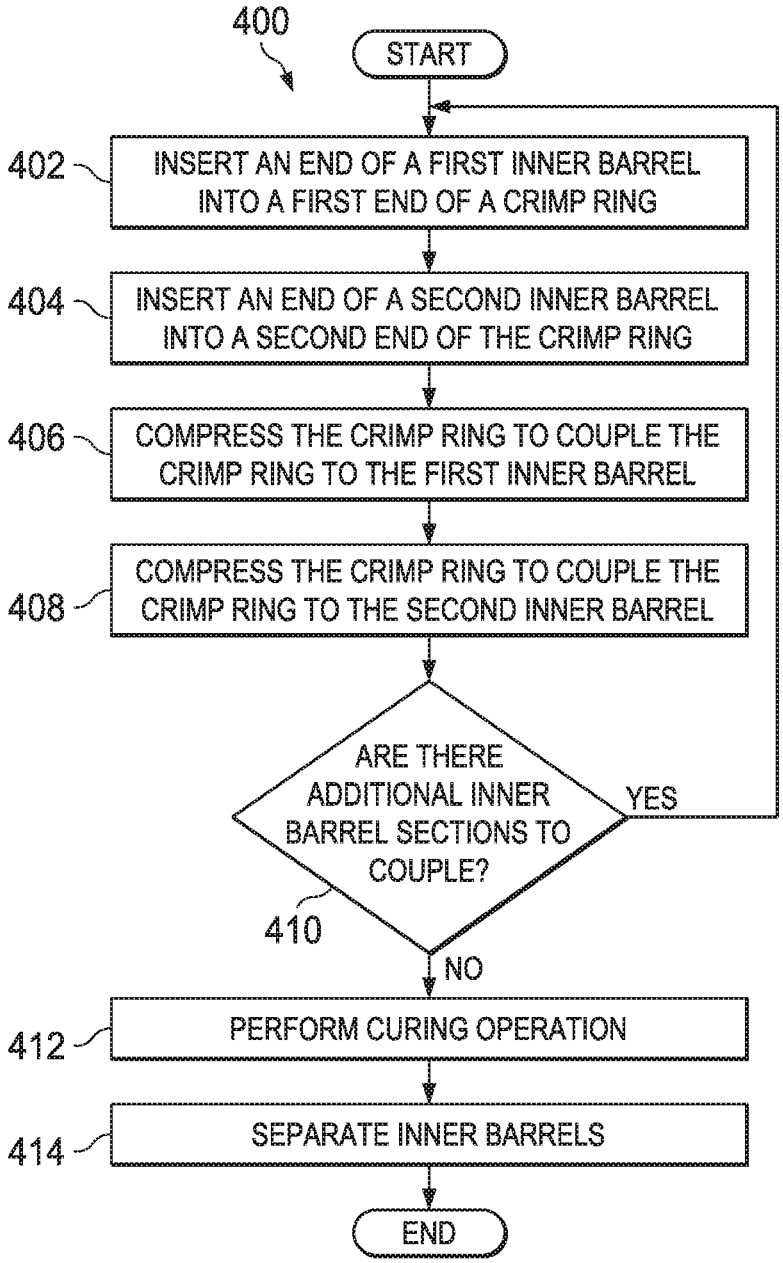
FIG. 4 is a flow chart for a method of coupling inner barrels using a crimp ring.

FIG. 4 is a flow chart of a method of coupling inner barrels using a crimp ring. A method 400 beings at step 402, where an operator inserts a first end of a first inner barrel into a first end of a crimp ring. For example, with reference to FIG. 3A, the operator may align the crimp ring 324 with the end 326-1 of the inner barrel 322-1. The crimp ring may be made of any suitable ductile material that withstands the conditions in the wellbore and has a high yield strength and high elongation, such as aluminum, steel, stainless steel, or copper. The operator may align the crimp ring on the outer perimeter of the first inner barrel by sliding the inner barrel into the crimp ring until the inner barrel is inserted by a predetermined distance. For example, the operator may insert the inner barrel into the crimp ring until the inner barrel contacts a shoulder located on the inner perimeter of the crimp ring.

The operator may position the crimp ring over one or more protrusions formed on the first inner barrel. The protrusions may increase the mechanical contact friction between the inner perimeter of the crimp ring and the outer perimeter of the inner barrel such that a larger pulling force is required to separate the crimp ring and the inner barrel after the crimp ring has been compressed. The protrusions may additionally provide a visual indicator to allow an installer to determine when the crimp ring is properly aligned on the end of the first inner barrel. The protrusions may have any suitable positive or negative shape and any suitable geometry.

In some examples, the operator may couple the crimp ring to the first inner barrel at the well site prior to a coring operation. In other examples, the operator may preinstall the crimp ring on an end of the first inner barrel prior to deployment of the first inner barrel to the well site. The crimp ring may be preinstalled on the first inner barrel via any suitable coupling, including crimping, welding, or threading. Preinstallation of the crimp ring on the first inner barrel may reduce the assembly time of the coring system at the well site.

At step 404, the operator may insert a first end of a second inner barrel into a second end of the crimp ring. For example, with reference to FIG. 3A, the operator may insert the end 326-2 of the inner barrel 322-2 into the crimp ring 324. The operator may position the crimp ring on the end of the second inner barrel in a manner similar to the manner described in step 402.

At step 406, the operator may compress the crimp ring to couple the crimp ring to the first inner barrel. For example, with reference to FIG. 3A, the operator may compress the portion of the crimp ring 324 surrounding the end 326-1 to couple the crimp ring 324 to the inner barrel 322-1. The compression may plastically deform the crimp ring such that the crimp ring fits snugly against the outer perimeter of the first inner barrel. The crimp ring and the inner barrel may be coupled using mechanical contact friction. The operator may compress crimp ring using any suitable tool for deforming metal including a piston pressure device or a crimping tool.

At step 408, the operator may compress the crimp ring to couple the crimp ring to the second inner barrel. For example, with reference to FIG. 3A, the operator may compress the portion of the crimp ring 324 surrounding the end 326-2 to couple the crimp ring 324 to the inner barrel 322-2. The operator may compress crimp ring to couple the crimp ring with the second inner barrel in a manner similar to the manner described in step 408.

At step 410, the operator may determine whether there are additional inner barrel sections to couple together. If there are additional inner barrels to couple, the method 400 may return to step 402 to install the next crimp ring to couple the next inner barrel. If there are no additional inner barrels to couple, the method 400 may proceed to step 412.

At step 412, the operator may use the coupled inner barrels during a coring operation. During the coring operation, the operator lowers the inner barrel assembly into an outer barrel located downhole in a wellbore, uses the inner barrel assembly to collect a core sample, and returns the inner barrel assembly to the surface to obtain the core sample. For example, with reference to FIG. 2, the inner barrels 216 are coupled to each other using the crimp rings 224 to create the inner barrel assembly. The inner barrels 216 are lowered into the outer barrel 118 and used to collect the core sample 220. Once the core sample 220 is in the inner barrels 216, the inner barrels 216 are returned to the surface 106 in order to obtain the core sample.

After the coring operation, at step 414, the operator may separate the inner barrel sections by severing the crimp ring such that no damaging of the inner barrels may be necessary. Because the inner barrels are not damaged, the potential for disturbing the core sample is reduced. The rig time and associated expense necessary for severing the inner barrels is also mitigated. Additionally, the inner barrel sections may be reused.

The crimp ring may be severed in a shear zone that may be formed of a material that is more brittle or easier to sever than the adjacent portions of the crimp ring such that the shear zone may be severed with less force than the adjacent portions of the crimp ring. The shear zone may be made of a different material than the adjacent portions of the crimp ring, may be thinner than the adjacent portions of the crimp ring, or may be heat-treated to increase the brittleness in the shear zone.

The operator may separate the inner barrels using the crimping tool used to compress the crimp ring in steps 406 and 408 by replacing the crimping jaws on the crimping tool with cutting jaws. The cutting jaws may sever the crimp ring, and depending on the parameters of the coring operation, also sever the core sample.

The steps of the method 400 may be completed in any order and some steps may be omitted or performed simultaneously with other steps. For example, steps 406 and 408 may be completed simultaneously.

Embodiments disclosed herein include:

A. An inner barrel system including a first coring inner barrel; a second coring inner barrel; and a crimp ring overlapping an end of the first coring inner barrel and an end of the second coring inner barrel and compressed to mechanically couple the first coring inner barrel with the second coring inner barrel.

B. A method for coupling coring inner barrel sections including inserting an end of a first coring inner barrel into a first end of a crimp ring; inserting an end of a second coring inner barrel into a second end of the crimp ring; and compressing the first and second ends of the crimp ring to mechanically couple the crimp ring to the end of the first coring inner barrel and the end of the second coring inner barrel.

C. A coring system including a core bit; a coring outer barrel coupled to the core bit; a coring inner barrel assembly inserted into the coring outer barrel. The coring inner barrel assembly including a first coring inner barrel; a second coring inner barrel; and a crimp ring overlapping an end of the first coring inner barrel and an end of the second coring inner barrel and compressed to mechanically couple the first coring inner barrel with the second coring inner barrel.

Each of embodiments A, B, and C may have one or more of the following additional elements in any combination: Element 1: wherein at least one of the first coring inner barrel or the second coring inner barrel includes a protrusion on an outer perimeter of at least one of the first coring inner barrel or the second coring inner barrel. Element 2: wherein the protrusion has at least one of a positive shape or a negative shape. Element 3: wherein a cross-sectional shape of the protrusion is at least one of a circle, oval, square, rectangle, and trapezoid. Element 4: wherein the crimp ring includes a shoulder extending from an inner perimeter of the crimp ring. Element 5: wherein the crimp ring includes a shear zone extending longitudinally along at least a portion of the crimp ring. Element 6: wherein the shear zone is an area that is more brittle than an adjacent portion of the crimp ring such that the shear zone severs with less force than the adjacent portion of the crimp ring. Element 7: wherein a thickness of the shear zone is less than a thickness of another portion of the crimp ring. Element 8: wherein the shear zone is scored. Element 9: further comprising positioning the crimp ring over at least one protrusion on an outer perimeter of at least one of the first coring inner barrel or the second coring inner barrel. Element 10: wherein inserting the end of at least one of the first coring inner barrel or second coring inner barrel includes inserting the end until the end contacts a shoulder extending from an inner perimeter of the crimp ring. Element 11: further comprising creating a shear zone extending longitudinally along at least a portion of the crimp ring. Element 12: wherein creating the shear zone includes locally heat treating the shear zone. Element 13: further comprising: performing a coring operation; and severing the crimp ring to separate the first and second inner barrels.

Although the present disclosure and its advantages have been described in detail, it should be understood that various changes, substitutions and alternations can be made herein without departing from the spirit and scope of the disclosure as defined by the following claims. For example, the crimp ring may additionally include features such as a small pressure release valve to release downhole pressure when the core sample is returned to the surface.

What is claimed is:

1. An inner barrel system, comprising:

a first coring inner barrel;

a second coring inner barrel, an end of the first coring inner barrel and an end of the second coring inner barrel spaced apart by a gap; and a crimp ring is placed over the gap to overlap the end of the first coring inner barrel and the end of the second coring inner barrel and compressed to mechanically couple the first coring inner barrel with the second coring inner barrel.

2. The system of claim 1, wherein at least one of the first coring inner barrel or the second coring inner barrel includes a protrusion on an outer perimeter of the at least one of the first coring inner barrel or the second coring inner barrel.

3. The system of claim 2, wherein the protrusion has at least one of a positive shape or a negative shape.

4. The system of claim 2, wherein a cross-sectional shape of the protrusion is at least one of a circle, oval, square, rectangle, and trapezoid.

5. The system of claim 1, wherein the crimp ring includes a shoulder extending from an inner perimeter of the crimp ring.

6. The system of claim 1, wherein the crimp ring includes a shear zone extending longitudinally along at least a portion of the crimp ring.

7. The system of claim 6, wherein the shear zone is an area that is more brittle than an adjacent portion of the crimp ring such that the shear zone severs with less force than the adjacent portion of the crimp ring.

8. The system of claim 6, wherein a thickness of the shear zone is less than a thickness of another portion of the crimp ring.

9. The system of claim 6, wherein the shear zone is scored.

10. A method for coupling coring inner barrel sections, comprising:

inserting an end of a first coring inner barrel into a first end of a crimp ring;

inserting an end of a second coring inner barrel into a second end of the crimp ring, the end of the first coring inner barrel and the end of the second coring inner barrel spaced apart by a gap; and compressing the first and second ends of the crimp ring to mechanically couple the crimp ring to the end of the first coring inner barrel and the end of the second coring inner barrel.

11. The method of claim 10, further comprising positioning the crimp ring over at least one protrusion on an outer perimeter of at least one of the first coring inner barrel or the second coring inner barrel.

12. The method of claim 10, wherein inserting the end of at least one of the first coring inner barrel or second coring inner barrel includes inserting the end until the end contacts a shoulder extending from an inner perimeter of the crimp ring.

13. The method of claim 10, further comprising creating a shear zone extending longitudinally along at least a portion of the crimp ring.

14. The method of claim 13, wherein creating the shear zone includes locally heat treating the shear zone.

15. The method of claim 10, further comprising:

performing a coring operation; and severing the crimp ring to separate the first and second inner barrels.

16. A coring system, comprising:

a core bit;

a coring outer barrel coupled to the core bit;

a coring inner barrel assembly inserted into the coring outer barrel, the coring inner barrel assembly including:

a first coring inner barrel;

a second coring inner barrel, an end of the first coring inner barrel and an end of the second coring inner barrel spaced apart by a gap; and a crimp ring is placed over the gap to overlap the end of the first coring inner barrel and the end of the second coring inner barrel and compressed to mechanically couple the first coring inner barrel with the second coring inner barrel.

17. The coring system of claim 16, wherein at least one of the first coring inner barrel or the second coring inner barrel includes a protrusion on an outer perimeter of at least one of the first coring inner barrel or the second coring inner barrel.

18. The coring system of claim 17, wherein the protrusion has at least one of a positive shape or a negative shape.

19. The coring system of claim 16, wherein the crimp ring includes a shear zone extending longitudinally along at least a portion of the crimp ring.

20. The coring system of claim 16, wherein the crimp ring includes a shoulder extending from an inner perimeter of the crimp ring.

* * * * *